United States Patent [19]

Ouchi et al.

[11] Patent Number: 4,714,104

[45] Date of Patent: Dec. 22, 1987

[54] METHOD OF CONTINUOUSLY CASTING A METAL AND AN APPARATUS FOR CONTINUOUSLY CASTING THE SAME

[75] Inventors: Yutaka Ouchi; Akio Sugino; Kazuo Sugaya; Kazuo Kimizima, all of Tsuchiura, Japan

[73] Assignee: Hitachi Cable, Ltd., Tokyo, Japan

[21] Appl. No.: 24,597

[22] Filed: Mar. 9, 1987

Related U.S. Application Data

[62] Division of Ser. No. 843,508, Mar. 25, 1986, Pat. No. 4,668,288.

[30] Foreign Application Priority Data

Mar. 26, 1985 [JP] Japan ..... 60-61667

[51] Int. Cl.[4] ..... C21C 7/10; C22B 9/04; C22B 9/05

[52] U.S. Cl. ..... 164/504; 164/253; 164/415; 164/417; 266/207; 266/208

[58] Field of Search ..... 164/415, 256, 253, 254, 164/474, 475, 477, 61, 66.1, 504, 417; 266/207, 208

[56] References Cited

U.S. PATENT DOCUMENTS 3,136,834 6/1964 Lorenz ..... 164/254 X

*Primary Examiner*—Kuang Y. Lin

*Attorney, Agent, or Firm*—Lowe, Price, LeBlanc, Becker & Shur

[57] ABSTRACT

A method of continuously casting a metal and an apparatus for continuously casting a metal wherein such a metal as copper, aluminum and so on is degassed continuously by means of at least two vacuum chambers which are installed over a preserving container for preserving a molten metal before being introduced to a mould and one of which pumps up the molten metal for degassing thereof while the other of which exhausts the molten metal after degassing thereof.

5 Claims, 3 Drawing Figures

METHOD OF CONTINUOUSLY CASTING A METAL AND AN APPARATUS FOR CONTINUOUSLY CASTING THE SAME

This is a division of application Ser. No. 843,508, now U.S. Pat. No. 4,668,288 filed Mar. 25, 1986.

FIELD OF THE INVENTION

The present invention relates to a method of continuously casting a metal and an apparatus for continuously casting a metal in which the effect of purifying a molten metal is improved.

DESCRIPTION OF THE PRIOR ART

It is preferable that a molten metal is exposed to vacuum atmosphere when such a molten metal is applied to a material for a purified product in quality whereby gasses or noxious impurities in the molten metal are removed.

There have been adopted following methods for degassing of a molten metal in the prior arts.

(a) A molten metal is dropped from a preserving furnace for accommodating the same to a vacuum tank positioned thereunder.

(b) The surface of a molten metal is exposed in a preserving furnace for accommodating the same to vacuum atmosphere provided thereover.

(c) A molten metal is pumped up from a preserving furnace for accommodating the same into a vacuum chamber provided thereover.

(d) A molten metal is sucked up into a sucking pipe by the blowing of Ar gas thereinto whereby the molten metal is continuously circulated.

In the methods mentioned above in the itmes (a) to (d), gasses or noxious impurities are removed from the molten metal to provide a purified materials in the process of casting a metal.

However, the following disadvantages should be resolved in the respective methods (a) to (d).

(a) The structure for w whole system is bigger in height.

(b) The structure for a vacuum chamber is bigger as a whole, and a continuous process is relatively hard to be performed because the preserving furnace is used as a bath for the molten metal.

(c) The fluctuation of the molten metal is remarkable in the surface thereof because a single vacuum chamber is installed therein so that a flow of the molten metal is not continuous to result in a difficulty in the application thereof to a continuous casting.

(d) The molten metal is decreased in the temperature thereof due to the blowing of Ar gas thereinto.

SUMMARY OF THE INVENTION

Accordingly, it is an object of the present invention to provide a method of an an apparatus for continuously casting a metal in which the structure for a whole system becomes smaller.

It is a further object of the present invention to provide a method of an an apparatus for continuously casting a metal in which the fluctuation of a molten metal is substantially prevented from being occurred in the surface thereof.

It is a still further object of the present invention to provide a method of and an apparatus for continuously casting a metal in which the temperature of a molten metal is maintained in the temperature thereof at a predetermined level.

According to the present invention, a method of and an apparatus for continuously casting a metal wherein there are provided at least two vacuum chambers in which a molten metal is pumped up into one of the vacuum chambers for degassing while the molten metal is exhausted from the other of the vacuum chambers after the degassing whereby the fluctuation of the molten metal is decreased in the surface thereof to be applied to a continuous casting.

BRIEF DESCRIPTION OF THE DRAWINGS

The present invention will be explained in more detail in accordance with following drawings wherein.

DESCRIPTION OF THE PREFERRED EMBODIMENT

Figure 1:
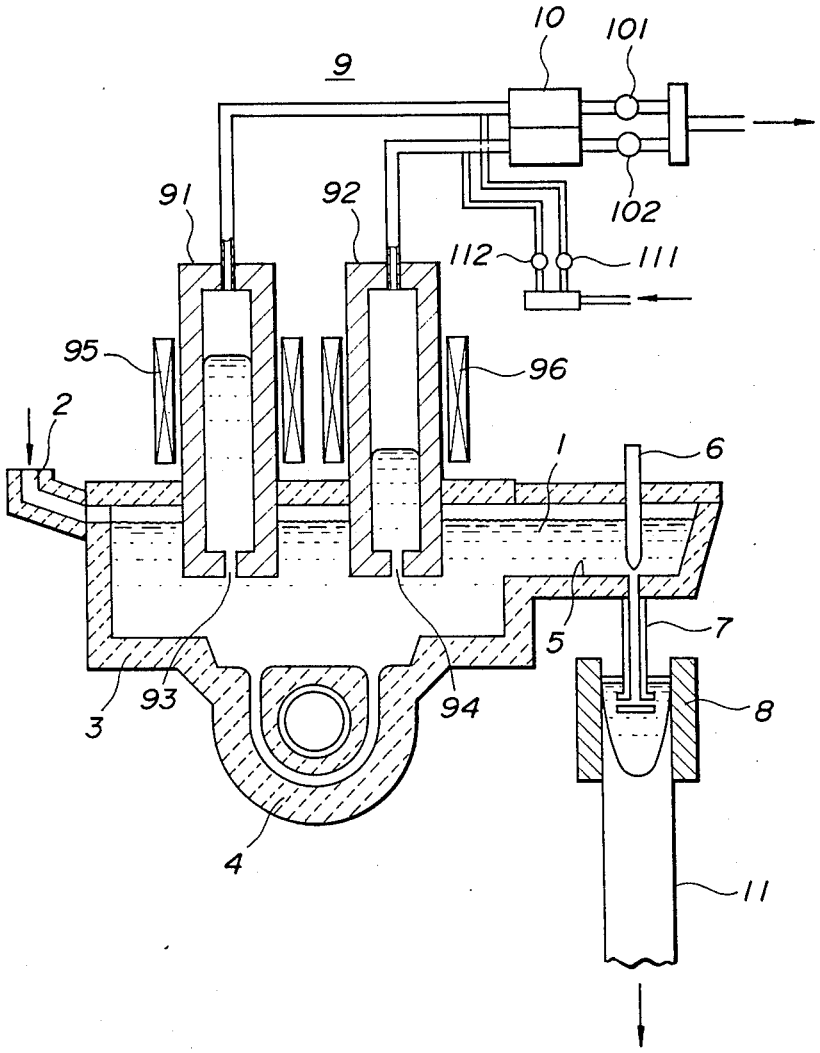
FIG. 1 is an explanatory view illustrating an embodiment of the present invention.

In FIG. 1, there is provided a preserving furnace 3 for accommodating a molten metal 1 through an inlet 2 supplied from a smelting furnace (not shown). The preserving furnace 3 is provided with an induction furnace 4 to maintain the temperature of the molten metal 1 at the predetermined level and with a nozzle 7 positioned beneath a stopper 6 for supplying the molten metal 1 from a tundish 5 to a mould 8 to produce an ingot 11. There is further provided a vacuum degassing means 9 comprising two vacuum chambers 91 and 92 installed at the same horizontal level over the preserving furnace 3. The vacuum chambers 91 and 92 are made of refractory material and respectively provided with openings 93 and 94 and with low frequency induction coils 95 and 96 positioned at the outer circumference thereof. Further, the vacuum chambers 91 and 92 are respectively connected through valves 101 and 102 to vacuum exhaust means like a vacuum pump (not shown) and through valves 111 and 112 to a source of inert gas like Ar of He. Here, reference numeral 10 indicates a dust collector.

In operation of a continuous casting, the molten metal 1 is supplied through the inlet 2 to a close type of the preserving furnace 3 and maintained in the temperature thereof at a predetermined level therein by the induction furnace 4. Thereafter, the molten metal 1 is introduced through the nozzle 7 from the tundish 5 to the mould 8 without being exposed directly to the air thereby being formed as an ingot 11.

Especially, according to the present invention, a portion of the molten metal 1 is pumped up into the vacuum chamber 91 by the opening of the valve 101 and the closing of the valve 102 while another portion of the molten metal 1 is exhausted from the vacuum chamber 92 by the opening of the valve 112 and the closing of the valve 111 wherein degassing will be processed in the vacuum chamber 91 while the purified molten metal is pumped out from the vacuum chamber 92 by the pressure of inert gas supplied through the opening valve 112 from the source of inert gas. Such a process of the degassing of the molten metal 1 is alternately at intervals of a predetermined time repeated between the vacuum chambers 91 and 92 by the opening and closing control of the valves 101, 102, 111 and 112. In such a process, the molten metal 1 is heated by the low frequency induction coils 95 and 96 and stirred by the electromagnetic force thereby to be maintained in the temperature thereof at a predetermined level and to be promoted in the effect of degassing.

In the vacuum chamber 91, the molten metal 1 is preserved for a predetermined time, for instance, two minutes after the vacuum degree therein reaches a predetermined level, for instance 0.5 Torr. The amount of the molten metal 1 is adjusted in the vacuum chambers 91 and 92 in accordance with the balance between the degree of vacuum and the pressure of inert gas. In order to facilitate the adjustment of the molten metal 1, it is preferable that the openings 93 and 94 are of slots or orifices like apertures having a smaller diameter than the inner diameter of the chambers 91 and 92.

Thus, the fluctuation is avoided in the surface of the molten metal 1 in the tundish 5.

A plural sets of vacuum chambers may be provided in place of two vacuum chambers 91 and 92. Instead, a single vacuum chamber may be divided to form a plurality of separate vacuum rooms.

A continuous casting of oxygen-free copper was practiced in an apparatus according to the present invention wherein vacuum degassing means 9 as illustrated in FIG. 1 was installed over a close type of a preserving furnace 3. In such a practice, the casting of the oxygen-free copper was done without any difficulties in the same manner as in a conventional apparatus in which there is not provided vacuum degassing means as mentioned above.

Figure 3:
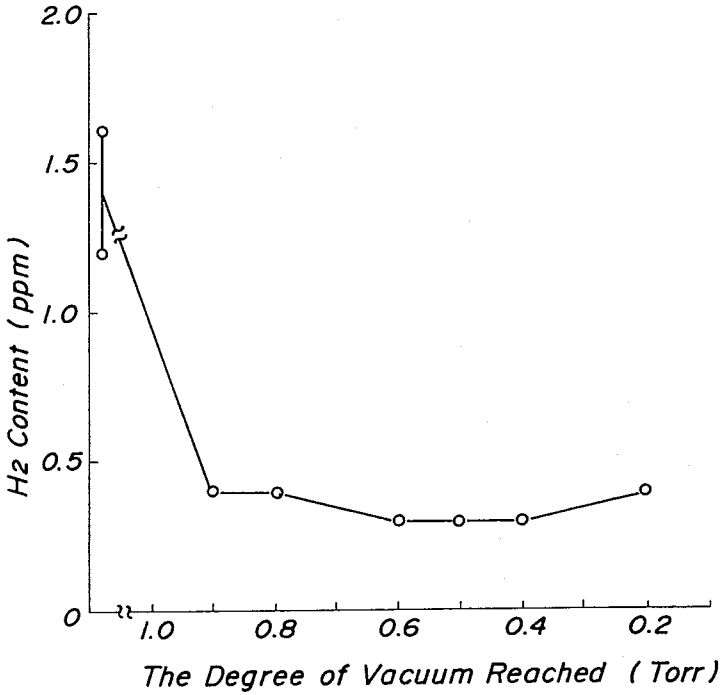
FIG. 3 is a chart graphically explaining a relation between the degree of vacuum and $H_2$ content.
Figure 2:
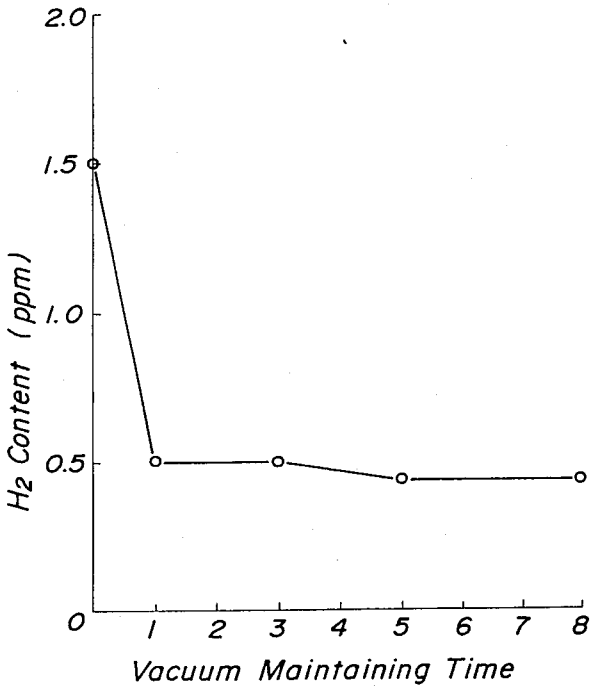
FIG. 2 is a chart graphically explaining a relation between vacuum maintaining time and $H_2$ content.

FIGS. 2 and 3 show a relation between $H_2$ content contained in the resulted oxygen-free copper and the vacuum degree and processing time in the vacuum chambers int he practice as mentioned above. That is, FIG. 2 shows a relation between $H_2$ content and vacuum preserving time at the vacuum degree of 0.5 Torr, and FIG. 3 shows a relation between $H_2$ content and the vacuum degree reached in the vacuum chambers at the vacuum preserving time of five minutes. As being explained in FIGS. 2 and 3, the processed time is enough in more than one minutes at the vacuum degree of 0.5 Torr while the vacuum degree to be reached in the vacuum chambers is enough in more than 0.9 Torr at the vacuum preserving time of five minutes.

In the above preferred embodiment, it is understood that the advantage of degassing is resulted in high purity copper, for instance, oxygen-free copper. However, the present invention may be applied to other metal, for instance, high purity aluminium including noxious gas.

Further, the present invention may be applied to an apparatus wherein batch type of vacuum chambers are provided in which two of the vacuum chambers are alternately decreased in pressure to shorten degassing time.

Still further, if degassing vacuum chambers are detachable and portable, the degassing vacuum chambers may be installed only when degassing is required in quality.

As explained above,the fluctuation is substantially avoided in the surface of a molten metal because at least two vacuum chambers degasses the molten metal alternately whereby the adjustment of supplying the molten metal becomes easy at a casting stopper and a metal material requiring purified quality is easily processed in a continuous casting apparatus.

In addition, the present invention may be applied to a conventional casting apparatus without any change in design or with less modification thereof whereby the increase of additional cost is avoided.

Although the present invention has been described with respect to a specific embodiment for complete and clear disclosure, the appended claims are not to be thus limited but are to be construed as embodying all modification and alternative constructions that may occur to one skilled in the art which fairly fall within the basic teaching herein set forth.

What we claim is:

1. An apparatus for continuously casting a metal comprising, a preserving container for accommodating a continuously supplied molten metal to be poured into a mould, and vacuum degassing means composed of at least two degassing chambers each being provided with opening dipped into said molten metal of said container for receiving and exhausting said molten metal, wherein said at least two degassing chambers are operated such that one of said at least two degassing chambers comtains said molten metal while the other of said at least two degassing chambers exhaust said molten metal.

2. An apparatus for continuously casting a metal according to claim 1, wherein said preserving container is of a close type.

3. An apparatus for continuously casting a metal according to claim 1, wherein said at least two degassing chambers are provided with induction coils at the circumference thereof.

4. An apparatus for continuously casting a metal according to claim 1, wherein said at least two degassing chamber are connected respectively to a source of inert gas, and said inert gas is introduced into said at least two degassing chambers for the exhalation of said molten metal.

5. An apparatus for continuously casting a metal according to claim 1, wherein said at least two degassing chambers are provided with said openings each having a smaller diameter than the inner diameter of said at least two degassing chambers.

* * * * *